US011407479B2

(12) United States Patent
Shibayama et al.

(10) Patent No.: US 11,407,479 B2
(45) Date of Patent: Aug. 9, 2022

(54) JET PROPULSION WATERCRAFT

(71) Applicant: YAMAHA HATSUDOKI KABUSHIKI KAISHA, Iwata (JP)

(72) Inventors: Susumu Shibayama, Shizuoka (JP); Yoshinori Yagi, Shizuoka (JP); Nobuharu Ota, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 53 days.

(21) Appl. No.: 17/001,827

(22) Filed: Aug. 25, 2020

(65) Prior Publication Data

US 2021/0078678 A1 Mar. 18, 2021

(30) Foreign Application Priority Data

Sep. 18, 2019 (JP) ..... JP2019-169464

(51) Int. Cl.
*B63B 34/70* (2020.01)
*B63B 34/10* (2020.01)
*B63H 11/117* (2006.01)

(52) U.S. Cl.
CPC ..... *B63B 34/10* (2020.02); *B63B 34/70* (2020.02); *B63H 11/117* (2013.01)

(58) Field of Classification Search
CPC ..... B63B 34/10; B63B 34/70; B63B 34/75; B63H 11/117
See application file for complete search history.

(56) References Cited

U.S. PATENT DOCUMENTS 6,807,922 B1 * 10/2004 Bills ..... B63B 34/10 114/363
7,140,318 B1 11/2006 Gasper
2009/0241822 A1 * 10/2009 Chapdelaine ..... B63B 23/00 114/125
2014/0026799 A1 1/2014 Kalil
2014/0261135 A1 * 9/2014 Gasper ..... G08G 3/00 114/284
2016/0039505 A1 2/2016 Okamoto et al.
2017/0137089 A1 * 5/2017 Wood ..... B63B 39/061

FOREIGN PATENT DOCUMENTS

JP 2016-037222 A 3/2016

* cited by examiner

*Primary Examiner* — Andrew Polay
(74) *Attorney, Agent, or Firm* — Keating and Bennett, LLP

(57) ABSTRACT

A jet propulsion watercraft includes a vessel body, a jet pump that is disposed at the vessel body and that includes a water jet opening, and a first guide that is attached to the vessel body. The jet pump generates a thrust by sucking in water existing around the vessel body and jetting the water from the water jet opening. The first guide receives water flowing on a lateral side of the vessel body and generates a downforce that generates a wake behind the vessel body.

18 Claims, 7 Drawing Sheets

JET PROPULSION WATERCRAFT

CROSS REFERENCE TO RELATED APPLICATIONS

This application claims the benefit of priority to Japanese Patent Application No. 2019-169464 filed on Sep. 18, 2019. The entire contents of this application are hereby incorporated herein by reference.

BACKGROUND OF THE INVENTION

1. Field of the Invention

The present invention relates to a jet propulsion watercraft.

2. Description of the Related Art

A marine sport called wakesurfing in which a surfer glides while riding on a wake generated by a vessel has been popularly played. The surfer can enjoy gliding more dynamically in proportion to an increase in magnitude of the wake. Japanese Patent Application Publication No. 2016-37222 discloses a jet propulsion watercraft. This jet propulsion watercraft is a small vessel that is called a personal watercraft (PWC). The thus-called jet propulsion watercraft has a small-sized, lightweight vessel body, and hence can be easily housed and transported, and provides easily-enjoyable water leisure.

The magnitude of a wake that can be generated by a vessel depends on the displacement of the vessel, and therefore it is necessary to prepare a comparatively large-sized vessel for wakesurfing. It is difficult to generate a wake large enough to enable a surfer to enjoy wakesurfing in a small-sized vessel, such as the jet propulsion watercraft of Japanese Patent Application Publication No. 2016-37222, which has a small displacement. Additionally, in the jet propulsion watercraft, a spray of water with a very large number of bubbles is generated when a jet flow caused by water jetted by a jet pump that is a propulsion device of the jet propulsion watercraft reaches a water surface. When the spray of water splashes onto a wake, a water surface part of the wake becomes rough, and therefore the surfer cannot easily ride on the wake. Therefore, in general, the jet propulsion watercraft has been regarded as being unsuitable for the purpose of use of wakesurfing, and wakesurfing that requires a vessel having a large displacement is not necessarily an easily-enjoyable marine sport.

SUMMARY OF THE INVENTION

Preferred embodiments of the present invention provide jet propulsion watercraft that each includes a vessel body, a jet pump that is disposed on the vessel body and that includes a water jet opening, and a first guide that is attached to the vessel body. The jet pump generates a thrust by sucking in water existing around the vessel body and jetting the water from the water jet opening. The first guide receives water flowing on a lateral side of the vessel body and generates a downforce that generates a wake behind the vessel body.

According to the above structural arrangement, the jet pump jets water from the water jet opening, and, as a result, a thrust is generated, and the jet propulsion watercraft travels. At that time, the first guide attached to the vessel body of the jet propulsion watercraft receives water flowing on the lateral side of the vessel body, and a downforce is generated. Thus, the vessel body sinks lower in the water, and therefore a displacement increases. Therefore, a larger wake than before the vessel body sinks lower in the water is generated behind the vessel body. Therefore, it is possible to generate a wake that is large enough to enable a surfer to enjoy wakesurfing even with a jet propulsion watercraft that has a small displacement when in a stationary state. Therefore, it becomes possible to easily enjoy wakesurfing.

According to a preferred embodiment of the present invention, the wake is a wake for wakesurfing.

According to the above structural arrangement, it is possible to generate a wake that is large enough to enjoy wakesurfing by causing the first guide to generate a downforce so as to sink the vessel body lower in the water even with the jet propulsion watercraft that has a small displacement when in a stationary state. Therefore, it is possible for the surfer to enjoy wakesurfing by riding on this wake.

According to a preferred embodiment of the present invention, the first guide is detachably attached to the vessel body.

According to the above structural arrangement, when a user wants to wakesurf, a wake for wakesurfing is generated by mounting the first guide on the vessel body and by causing the jet propulsion watercraft to travel, and therefore the user is able to enjoy wakesurfing by riding on this wake.

According to a preferred embodiment of the present invention, the first guide is detachably attached to a rear portion of the vessel body.

According to the above structural arrangement, when the first guide attached to the rear portion of the vessel body generates a downforce, at least the rear portion of the vessel body sinks lower in the water, and therefore the displacement increases at least in the rear portion of the vessel body of the jet propulsion watercraft. Thus, a large wake for wakesurfing is generated behind the vessel body, and therefore the surfer is able to enjoy wakesurfing by riding on the wake that has become larger due to the vessel body sinking lower in the water.

According to a preferred embodiment of the present invention, the first guide is disposed asymmetrically relative to a center in a width direction of the vessel body.

According to the above structural arrangement, a wake for wakesurfing is generated on a side closer to one lateral side in the width direction of the vessel body, and therefore the surfer is able to enjoy wakesurfing by riding on this wake when positioned on one lateral side at the rear.

According to a preferred embodiment of the present invention, the first guide is disposed at a more sideward position than the water jet opening.

According to the above structural arrangement, the first guide is disposed at a more sideward position than the water jet opening, and thus is disposed asymmetrically from the center in the width direction of the vessel body. Thus, a wake for wakesurfing is generated on a side closer to one lateral side in the width direction of the vessel body, and therefore the surfer is able to enjoy wakesurfing by riding on this wake when positioned on one lateral side at the rear.

According to a preferred embodiment of the present invention, the first guide is provided with a first region that is downwardly pushed by water flowing on one lateral side of the vessel body and a second region that guides water flowing on the one lateral side of the vessel body toward the other lateral side of the vessel body.

According to the above structural arrangement, the first region of the first guide generates a downforce by being downwardly pushed by water flowing on one lateral side of the vessel body, and therefore a wake for wakesurfing is generated as described above. The second region of the first guide guides water flowing on the one lateral side of the vessel body toward the other lateral side of the vessel body. Water guided in this way crosses the water jet opening of the jet pump. Thus, it less likely for a jet flow generated by water jetted from the jet water opening to reach the water surface, and therefore it is unlikely for the jet flow to cause a spray of water. Therefore, it is possible to prevent a water surface portion of the wake from becoming rough due to splashing or spraying of water onto the wake, and therefore the surfer is able to easily ride on the wake generated by the first region, and enjoy wakesurfing more.

According to a preferred embodiment of the present invention, the first guide guides water flowing on one lateral side of the vessel body to a more rearward and more upward position than the water jet opening.

According to the above structural arrangement, the first guide generates a downforce by being downwardly pushed by water flowing on one lateral side of the vessel body, and therefore a wake for wakesurfing is generated as described above. The first guide guides water flowing on one lateral side of the vessel body to a more rearward and more upward position than the water jet opening of the jet pump. Water guided in this way crosses the water jet opening at a more rearward and more upward position than the water jet opening of the jet pump. Thus, it becomes less likely for a jet flow caused by water jetted rearwardly from the water jet opening to reach the water surface, and therefore it is unlikely for the jet flow to cause a spray of water. Therefore, it is possible to significantly reduce or prevent a water surface portion of the wake from becoming rough due to the splashing or spraying of water onto the wake, and therefore the surfer is able to easily ride on the wake generated by the first guide, and enjoy wakesurfing more.

According to a preferred embodiment of the present invention, the first guide sets a location at which water flowing on the lateral side of the vessel body and water flowing on the other lateral side of the vessel body are joined together so as to be closer to the vessel body compared to a case in which the first guide is not disposed on the vessel body.

According to the above structural arrangement, the first guide guides water flowing on one lateral side of the vessel body toward a position located near the water jet opening of the jet pump. Water guided in this way crosses the water jet opening at the position located near the water jet opening of the jet pump. Thus, it becomes less likely for a jet flow caused by water jetted from the water jet opening to reach the water surface, and therefore it is unlikely for the jet flow to cause a spray of water. Therefore, it is possible to significantly reduce or prevent a water surface portion of the wake from becoming rough due to the splashing or spraying of water onto the wake, and therefore the surfer is able to easily ride on the wake generated by the first guide, and enjoy wakesurfing more.

According to a preferred embodiment of the present invention, the first guide has a curved plate shape, and the first region and the second region include curved surfaces that are continuous with each other.

According to the above structural arrangement, in the first guide having a curved plate shape, the first region and the second region each of which includes a curved surface are continuous with each other, and therefore it is possible for water flowing on one lateral side of the vessel body to smoothly pass through the entire area of the first and second regions. Therefore, it is possible for the first guide to generate a downforce by being pushed downwardly by water passing through the first region and to guide water flowing through the second region toward the other lateral side of the vessel body.

According to a preferred embodiment of the present invention, the jet propulsion watercraft further includes a ballast tank disposed at a front portion of the vessel body.

According to the above structural arrangement, not only the first guide but also the ballast tank disposed at the front portion of the vessel body generates a downforce, and, as a result, the entirety of the vessel body sinks lower in the water, and therefore the displacement of the jet propulsion watercraft further increases. Thus, a larger wake for wakesurfing is generated behind the vessel body, and therefore the surfer is able to ride on a wake that has become larger due to the vessel body sinking lower in the water, and enjoy wakesurfing more.

According to a preferred embodiment of the present invention, the jet propulsion watercraft further includes an attachment plate that is detachably attached to a rear portion of the vessel body and that extends the rear portion of the vessel body rearwardly.

According to the above structural arrangement, the attachment plate attached to the rear portion of the vessel body extends the rear portion of the vessel body rearwardly, and therefore it is possible to expand the uses of the jet propulsion watercraft by placing things on the attachment plate or by attaching another device to the attachment plate.

According to a preferred embodiment of the present invention, the jet propulsion watercraft further includes a second guide that is disposed at a side edge of the attachment plate and that straightens a water surface region in a wake generated by the first guide.

According to the above structural arrangement, the second guide disposed at a side edge of the attachment plate straightens a water surface region in a wake generated by the first guide, and therefore it is possible to prevent a water surface portion of the wake from becoming rough. Thus, the surfer is able to easily ride on the wake, and enjoy wakesurfing more.

According to a preferred embodiment of the present invention, the first guide is attached to the second guide.

According to the above structural arrangement, a combination of the attachment plate, the first guide, and the second guide makes it possible to generate a wake whose water surface portion is less rough, and therefore the surfer is able to easily ride on this wake, and enjoy wakesurfing more.

According to a preferred embodiment of the present invention, the second guide is attachable and detachable to and from the side edge of the attachment plate.

According to the above structural arrangement, it is possible for the user to attach or detach the second guide when necessary.

According to a preferred embodiment of the present invention, the second guide includes an inner guide that guides water that has been brought into contact with the vessel body toward the center in the width direction of the vessel body.

According to the above structural arrangement, water that has been brought into contact with the vessel body is guided toward the center in the width direction of the vessel body by the inner guide, and thus is spaced apart from a wake generated by the first guide. Therefore, it is possible to prevent a water surface portion of the wake from becoming rough due to water that has been brought into contact with the vessel body, and therefore the surfer is able to easily ride on the wake generated by the first guide, and enjoy wakesurfing more.

According to a preferred embodiment of the present invention, a rear end portion of the inner guide is curved so as to approach the center as it extends rearwardly.

According to the above structural arrangement, the inner guide that has the rear end portion curved so as to approach the center in the width direction of the vessel body as it extends rearwardly effectively guides water that has been brought into contact with the vessel body toward the center.

According to a preferred embodiment of the present invention, the second guide includes an outer guide that is disposed farther apart from the center in the width direction than the inner guide. The outer guide guides water flowing on a lateral side of the outer guide toward the center.

According to the above structural arrangement, water flowing on the lateral side of the outer guide is guided toward the center in the width direction of the vessel body by the outer guide, and thus is spaced apart from a wake generated by the first guide. Therefore, it is possible to prevent a water surface portion of the wake from becoming rough due to water flowing on the lateral side of the outer guide, and therefore the surfer is able to easily ride on the wake generated by the first region, and enjoy wakesurfing more.

According to a preferred embodiment of the present invention, the outer guide includes a curved surface.

According to the above structural arrangement, it is possible for the outer guide including the curved surface to smoothly guide water flowing on the lateral side of the outer guide toward the center in the width direction of the vessel body.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
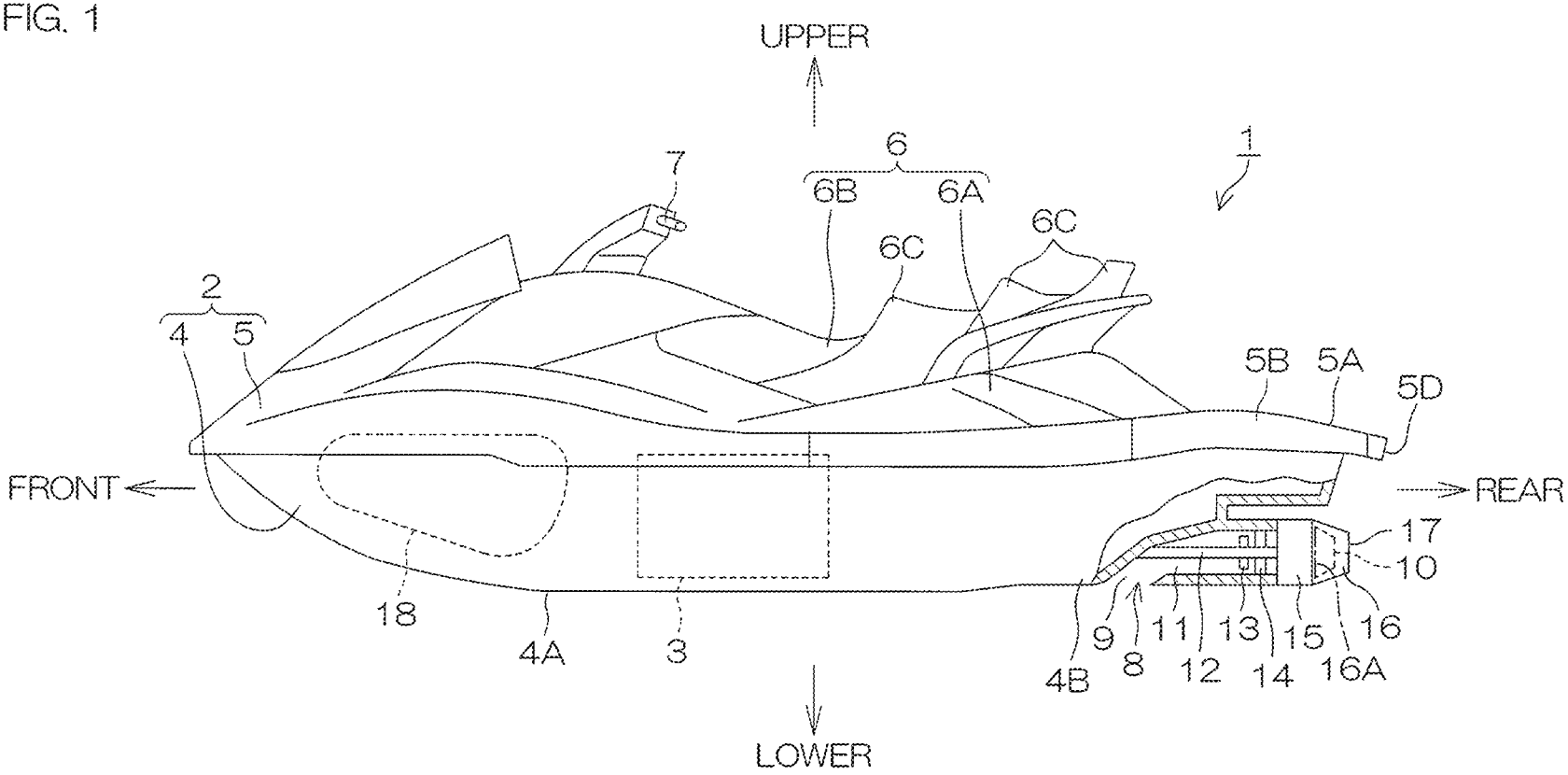
FIG. 1 is a side view of a jet propulsion watercraft according to a preferred embodiment of the present invention.

Preferred embodiments of the present invention will be hereinafter described in detail with reference to the accompanying drawings. FIG. 1 is a left side view of a jet propulsion watercraft 1 according to a preferred embodiment of the present invention. A right-left direction in FIG. 1 is a front-rear direction of the jet propulsion watercraft 1. A left side in FIG. 1 is a front side of the jet propulsion watercraft 1. A right side in FIG. 1 is a rear side of the jet propulsion watercraft 1. In the following description, the right-left direction of the jet propulsion watercraft 1 is defined based on when the jet propulsion watercraft 1 is directed forwardly. In other words, a near side in a direction perpendicular to the plane of paper of FIG. 1 is a left side of the jet propulsion watercraft 1, and a far side in the direction perpendicular to the plane of paper of FIG. 1 is a right side of the jet propulsion watercraft 1.

The jet propulsion watercraft 1 includes a vessel body 2 that is substantially laterally symmetrical and an engine 3 housed in the vessel body 2. The vessel body 2 includes a hull 4 that defines a vessel bottom and a deck 5 disposed above the hull 4, and extends longitudinally in the front-rear direction. The engine 3 is disposed in an engine room located between the hull 4 and the deck 5 in the up-down direction. The engine 3 is preferably an internal combustion engine including a crankshaft (not shown) that rotates around a crankshaft axis (not shown) extending in the front-rear direction. In the hull 4, a keel 4A is disposed at a position that coincides with a center C in the width direction of the vessel body 2 in a plan view (see FIG. 7 described below). The lateral side of the vessel body 2 denotes a more leftwardly outer side or a more rightwardly outer side than the keel 4A.

The jet propulsion watercraft 1 additionally includes a seat 6 on which a user sits as a rider, a steering handle 7 that is operated rightwardly and leftwardly by the user sitting on the seat 6, and a jet pump 8 attached to a rear portion of the vessel body 2. The seat 6 and the steering handle 7 are disposed side by side in the front-rear direction in an upper portion of the vessel body 2. More specifically, the seat 6 is disposed at a central portion of the deck 5, and the steering handle 7 is disposed at a position that is able to be reached by the user's hands when the user sitting on the seat 6 forwardly extends his/her arms. A throttle lever (not shown) is attached to a left end portion or a right end portion of the steering handle 7, and the driving force of the engine 3 is adjusted by the user operating the throttle lever.

The jet pump 8 is disposed at a more rearward position than the engine 3. The jet pump 8 sucks in water by the driving force of the engine 3 from the vessel bottom, and jets it outwardly from the vessel body 2. Thus, the jet pump 8 generates a thrust to propel the jet propulsion watercraft 1.

More specifically, the jet pump 8 includes a water intake port 9 that opens in a rear portion 4B of the hull 4 and that sucks in water existing around the vessel body 2, a water outlet port 10 that rearwardly opens at a more rearward position than the water intake port 9, and a flow passage 11 that guides water that has been sucked into the water intake port 9 to the water outlet port 10. The jet pump 8 additionally includes a drive shaft 12 that extends in the front-rear direction, an impeller 13 and a stationary blade 14 both of which are disposed in the flow passage 11, a nozzle 15, and a deflector 16 that rightwardly and leftwardly deflects a direction in which water is jetted rearwardly from the nozzle 15.

A front end portion of the drive shaft 12 is disposed in the vessel body 2, and is connected to the crankshaft (not shown) of the engine 3 through a joint, etc. (not shown). A rear end portion of the drive shaft 12 is disposed in the flow passage 11, and is connected to the impeller 13. The stationary blade 14 is disposed behind the impeller 13, and the nozzle 15 is disposed behind the stationary blade 14. The stationary blade 14 and the nozzle 15 are fixed to the flow passage 11.

The impeller 13 is rotatable around a central axis of the drive shaft 12 in the flow passage 11. The impeller 13 is rotationally driven around the central axis of the drive shaft 12 together with the drive shaft 12 by the engine 3. When the impeller 13 is rotationally driven, water existing around the vessel body 2 is sucked in through the water intake port 9 into the flow passage 11, and is sent from the impeller 13 to the stationary blade 14. The twist of a water flow generated by the rotation of the impeller 13 is reduced by causing water sent by the impeller 13 to pass through the stationary blade 14, and the water flow is straightened. Therefore, water whose flow has been straightened is sent from the stationary blade 14 to the nozzle 15. The nozzle 15 has a cylindrical shape that extends in the front-rear direction, and the water outlet port 10 is located at a rear end portion of the nozzle 15. The water sent to the nozzle 15 is jetted rearwardly from the water outlet port 10.

The deflector 16 is cylindrical, and extends rearwardly from the nozzle 15. The deflector 16 is connected to the nozzle 15 so as to be rightwardly and leftwardly rotatable around a deflector axis 16A that extends upwardly and downwardly. The water outlet port 10 of the nozzle 15 is disposed in the deflector 16. A jet opening 17 that is rearwardly opened is provided in the deflector 16. The jet opening 17 is disposed behind the water outlet port 10. Water that has been jetted rearwardly from the water outlet port 10 passes through the inside of the deflector 16, and is jetted rearwardly from the jet opening 17. Thus, a forward thrust is generated. The deflector 16 rightwardly and leftwardly turns around the deflector axis 16A in accordance with the operation of the steering handle 7. Thus, the direction of water jetted from the jet pump 8, i.e., the direction of the thrust is changed rightwardly and leftwardly by the operation of the steering handle 7, and therefore the jet propulsion watercraft 1 is steered.

Figure 7:
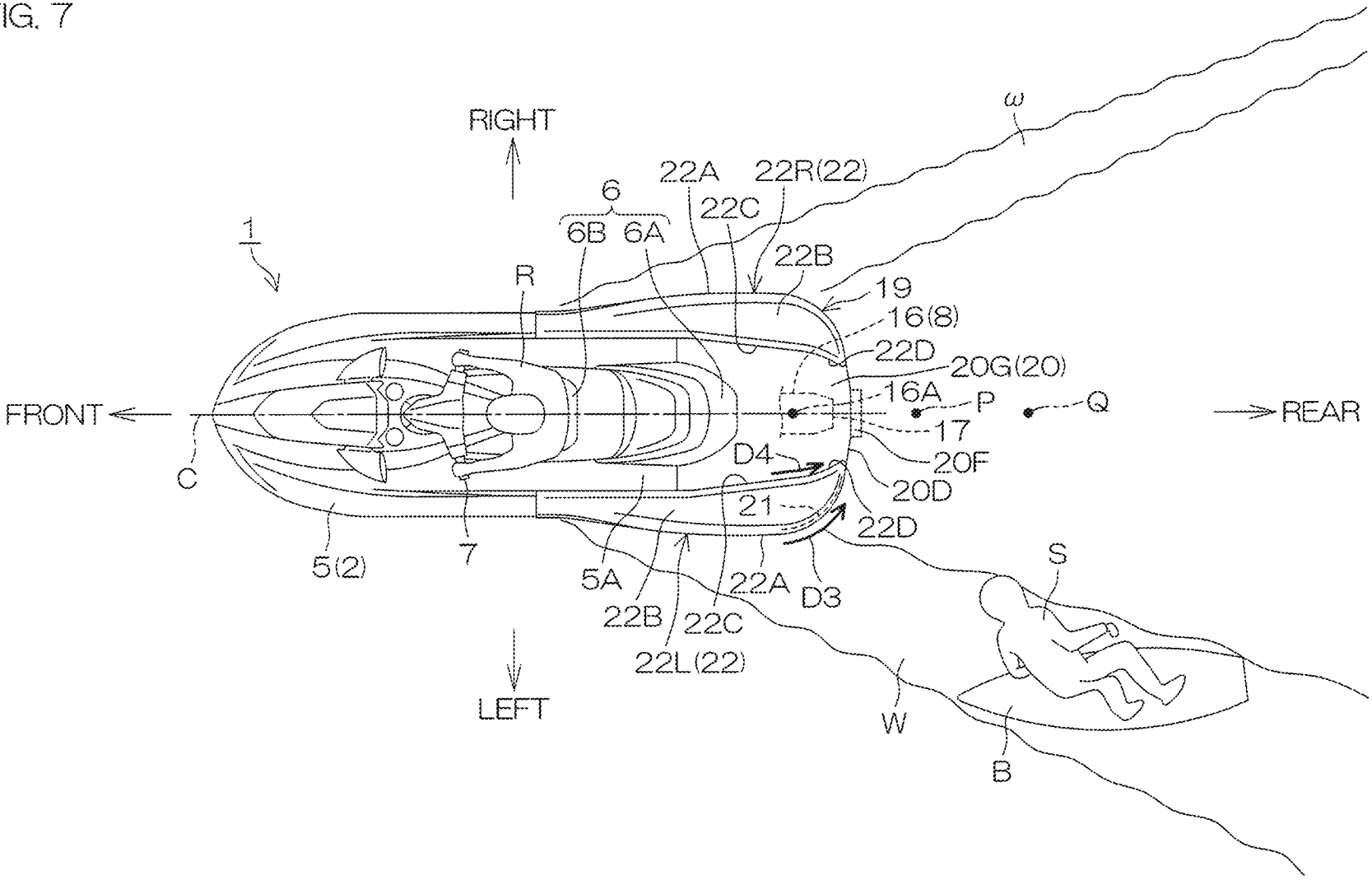
FIG. 7 is a plan view of the jet propulsion watercraft on which the expansion device has been mounted.

The deflector axis 16A coincides with the center C in the width direction of the vessel body 2 in a plan view (see FIG. 7). Therefore, the jet opening 17 directed straight rearwardly along the center C coincides with the center C in a plan view when the jet propulsion watercraft 1 advances in a straight line, whereas the jet opening 17 directed diagonally rearwardly intersects the center C at least near the center C in a plan view when the jet propulsion watercraft 1 turns.

The deck 5 includes a transom step 5A located at a more rearward position than the seat 6. The transom step 5A defines the rear portion of the vessel body 2. The transom step 5A has a plate shape including a left edge 5B and a right edge 5C, each of which extends in the front-rear direction, and a rear edge 5D that extends between rear ends of these edges and that extends rightwardly and leftwardly (see FIG. 3 described below). The left edge 5B projects more leftwardly than the rear portion 4B of the hull 4, and the right edge 5C projects more rightwardly than the rear portion 4B of the hull 4, and the rear edge 5D projects more rearwardly than the rear portion 4B of the hull 4.

The seat 6 includes a base portion 6A that rises from the deck 5 and a seat portion 6B that is disposed at an upper end portion of the base portion 6A and on which a user is stationed. In the present preferred embodiment, three users are able to sit on the seat portion 6B when lined up in the front-rear direction. Three convex portions 6C each of which maintains the sitting state of a user by contacting the user's waist are disposed at the seat portion 6B are lined up in the front-rear direction. A front portion of the transom step 5A clamps a rear portion of the base portion 6A in the right-left direction (see FIG. 3).

A ballast tank 18 is disposed at a front portion of the vessel body 2. A well-known water supply and drainage mechanism (not shown) that supplies and drains water to and from the ballast tank 18 is disposed on the vessel body 2. The front portion of the vessel body 2 sinks lower when water is supplied to the ballast tank 18, whereas the front portion of the vessel body 2 floats higher when water is drained from the ballast tank 18.

Figure 2:
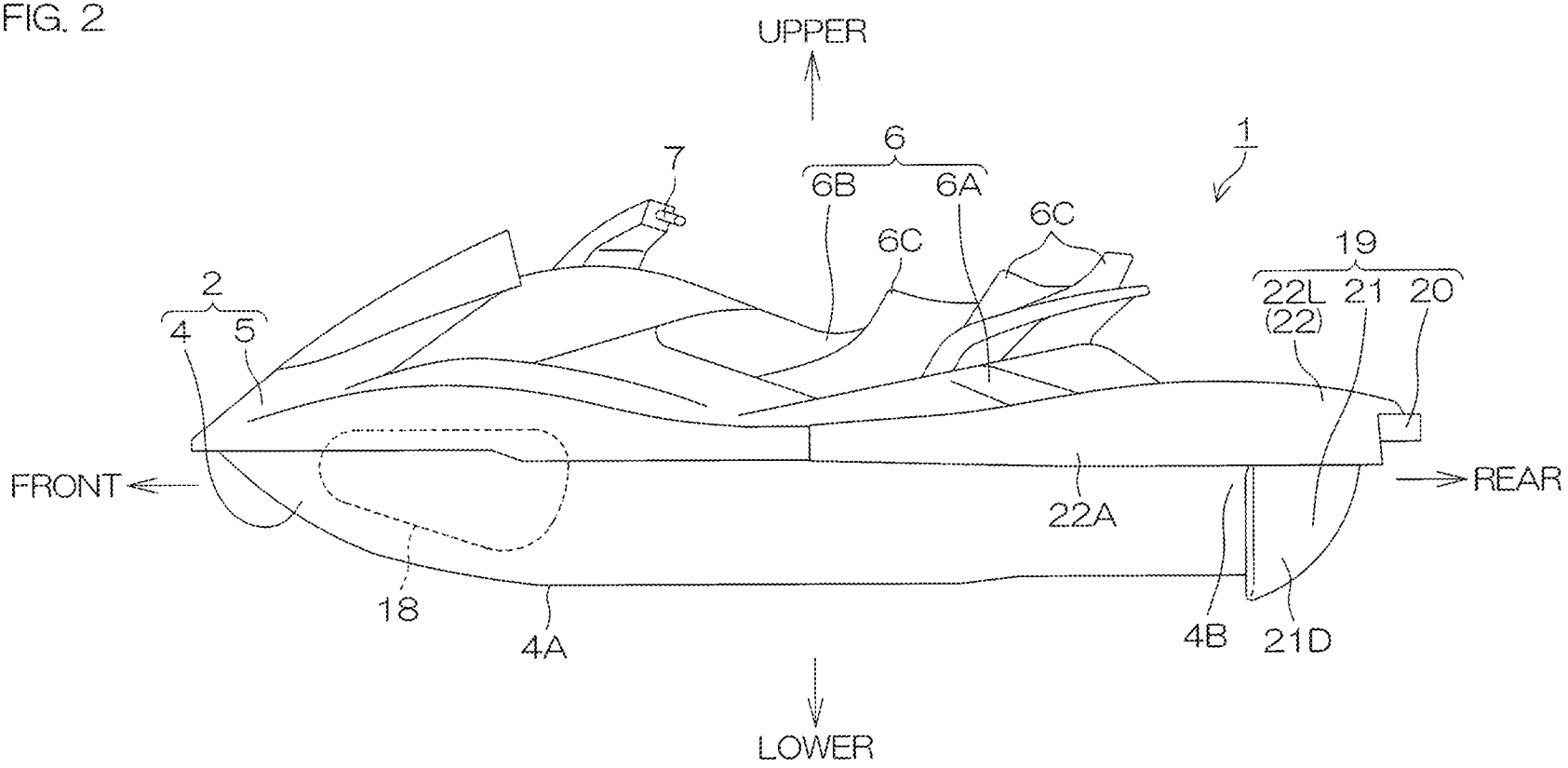
FIG. 2 is a side view of the jet propulsion watercraft in a state in which an expansion device has been mounted.

An expansion device 19 shown in FIG. 2 is attachable to the transom step 5A of the vessel body 2. The attached expansion device 19 defines a portion of the jet propulsion watercraft 1. The expansion device 19 includes an attachment 20 that is attached to the transom step 5A, and a first guide 21 and a second guide 22 each of which is attached to the transom step 5A through the attachment 20.

Figure 3:
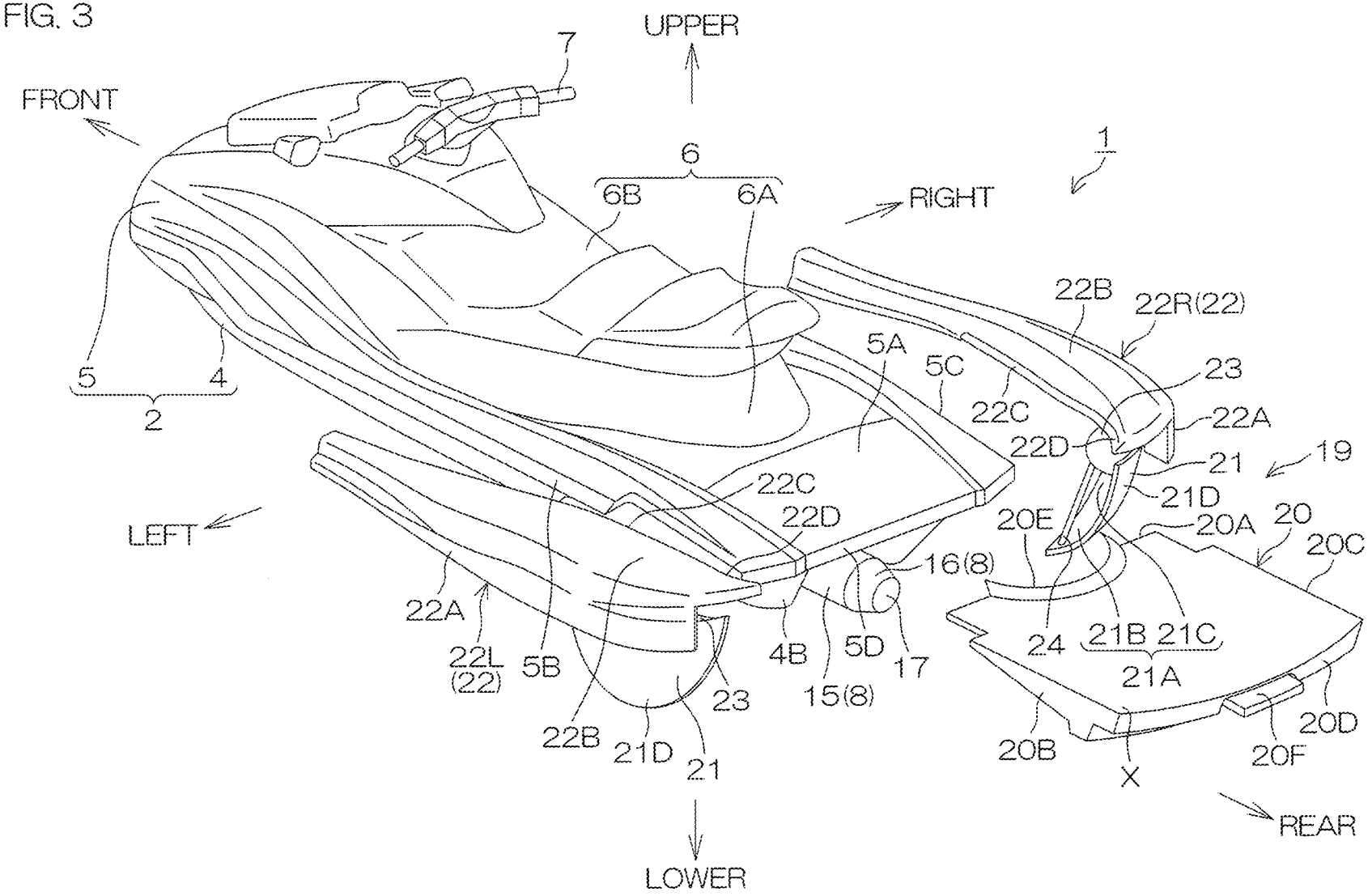
FIG. 3 is an exploded perspective view of the jet propulsion watercraft.

FIG. 3 is an exploded perspective view of the jet propulsion watercraft 1. The attachment 20 is plate-shaped or substantially plate-shaped, rectangular or substantially rectangular, and laterally symmetrical. Therefore, the attachment 20 includes a front edge 20A, a left edge 20B that extends rearwardly from a left end of the front edge 20A, a right edge 20C that extends rearwardly from a right end of the front edge 20A, and a rear edge 20D that extends between a rear end of the left edge 20B and a rear end of the right edge 20C and extends rightwardly and leftwardly. A circular-arc concave portion 20E that is rearwardly hollow is provided at a center of the front edge 20A. Each of the left and right edges 20B and 20C defines a side edge of the attachment 20. A convex portion 20F that protrudes rearwardly is provided at a center of the rear edge 20D.

The second guide 22 includes a pair of second guides 22L and 22R that are laterally symmetrical. The second guides 22L and 22R, i.e., each second guide 22 includes an integral outer guide 22A including a vertical plate that is elongated in the front-rear direction and an inner guide 22B including a horizontal plate that is elongated in the front-rear direction and that extends from the outer guide 22A inwardly toward the center C of the vessel body 2.

The outer guide 22A is disposed more outwardly from the center C in the width direction than the inner guide 22B. The outer guide 22A has the same or substantially the same front-to-rear length as the left edge 5B and the right edge 5C of the transom step 5A. The outer guide 22A has a curved shape. More specifically, the outer guide 22A is outwardly curved smoothly so as to become more distant from the center C as it extends rearwardly from its front end, and is inwardly curved at a rear end portion of the outer guide 22A. Additionally, an upper end portion of the outer guide 22A is inwardly bent smoothly, and extends to the inner guide 22B.

The inner guide 22B has the same or substantially the same front-to-rear length as the outer guide 22A. The inner guide 22B becomes wider as it extends rearwardly. Therefore, in the inner guide 22B, an inner edge 22C closer to the center C approaches the center C as it extends rearwardly, and particularly a rear end portion 22D of the inner edge 22C is curved so as to approach the center C as it extends rearwardly.

Although the first guides 21 are attached to both the second guide 22L and the second guide 22R in FIG. 3, the first guide 21 may be attached to either the second guide 22L or the second guide 22R in practice. The first guide 21 has a curved plate shape with a center of curvature closer to the center C than the first guide 21. In a side view, the first guide 21 is substantially semicircular. A tabular bracket 23 that projects from an upper end of the first guide 21 to the center of curvature is attached to the first guide 21. Additionally, a pillar-shaped stay 24 that slenderly extends upwardly and downwardly extends between a lower end portion of the first guide 21 and the bracket 23. A surface that faces the center of curvature in the first guide 21 defines an inner surface 21A of the first guide 21. The inner surface 21A includes a first region 21B curved toward the center C while becoming narrower as it extends downwardly defines a lower region of the inner surface 21A, and a second region 21C curved so as to become wider as it extends upwardly defines an upper region of the inner surface 21A. The first region 21B and the second region 21C are curved-surfaces that are continuous with each other. An outer surface 21D on the side opposite to the inner surface 21A in the first guide 21 is curved and is parallel or substantially parallel to the inner surface 21A. A lower end of the stay 24 is connected to a lower end of the first region 21B.

Figure 4:
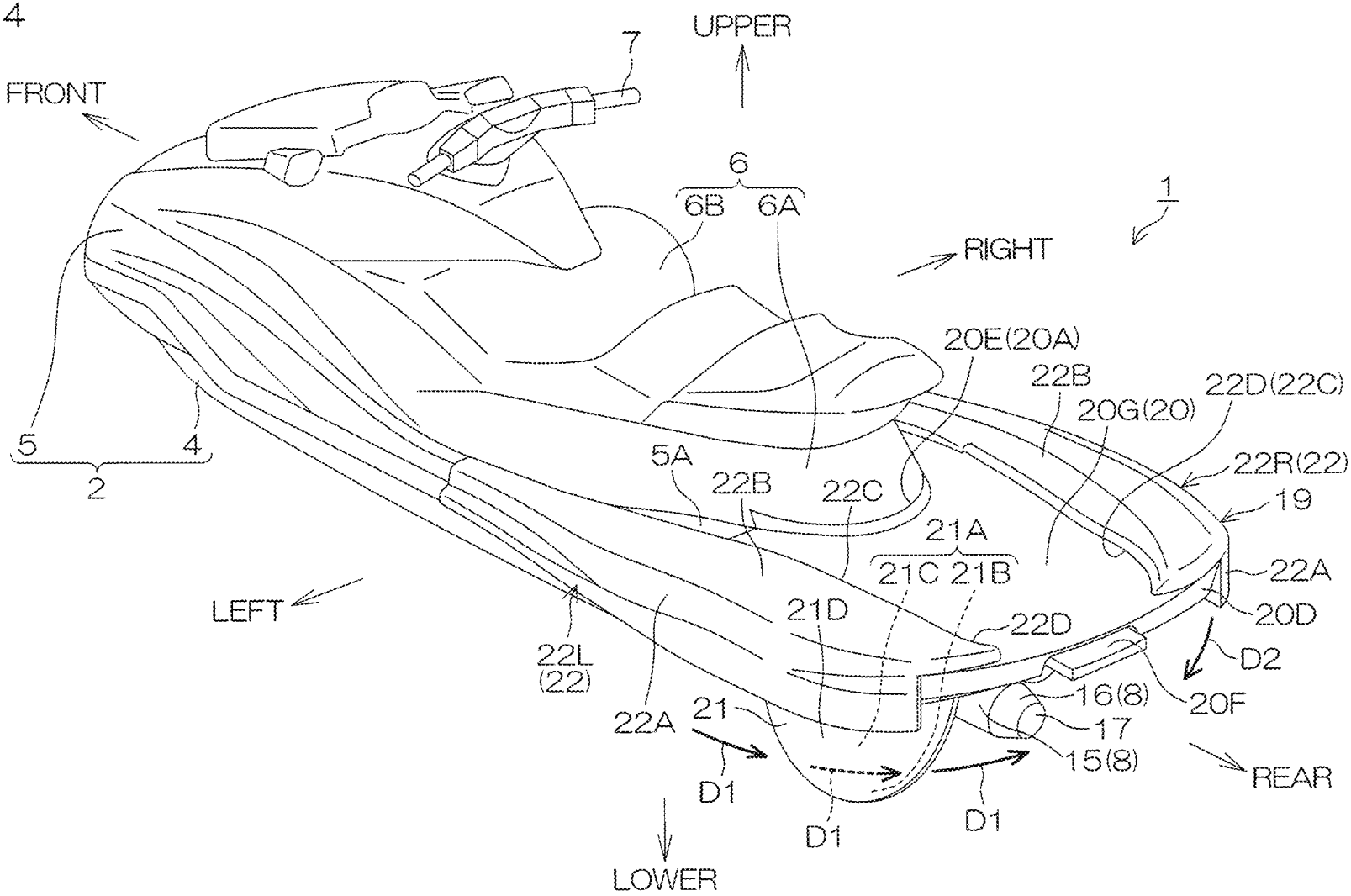
FIG. 4 is a perspective view of the jet propulsion watercraft in a state in which the expansion device has been mounted.

Referring additionally to FIG. 4 that shows the jet propulsion watercraft 1 in a state in which the expansion device 19 has been attached, a description will be given of the mounting of the expansion device 19 on the transom step 5A of the vessel body 2. First, a user attaches the attachment 20 to the transom step 5A. A fastening member, such as a bolt or nut, or a well-known snap fit may be used to attach the attachment 20. The same applies to a method of attaching the first guide 21 and a method of attaching the second guide 22. The attachment 20 is fixed to the transom step 5A so as to be parallel or substantially parallel to the transom step 5A, and the concave portion 20E of the attachment 20 is fitted to a rear end portion of the base portion 6A of the seat 6. The left edge 20B of the attachment 20 substantially coincides with the left edge 5B of the transom step 5A. The right edge 20C of the attachment 20 substantially coincides with the right edge 5C of the transom step 5A. The rear edge 20D of the attachment 20 protrudes more rearwardly than the rear edge 5D of the transom step 5A. Therefore, the rear portion of the vessel body 2 is extended rearwardly.

Thereafter, the user attaches the second guide 22L and the second guide 22R to the left edge 20B and the right edge 20C of the attachment 20, respectively. When the second guide 22L is attached to the attachment 20, the outer guide 22A covers the left edge 20B and the left edge 5B of the transom step 5A from the outside left, and the inner guide 22B covers a left end portion of the attachment 20 from above. A curved rear end portion of the outer guide 22A covers a left end portion of the rear edge 20D of the attachment 20 from behind. When the second guide 22R is attached to the attachment 20, the outer guide 22A covers the right edge 20C and the right edge 5C of the transom step 5A from the outside right, and the inner guide 22B covers a right end portion of the attachment 20 from above. The curved rear end portion of the outer guide 22A covers a right end portion of the rear edge 20D of the attachment 20 from behind. A central portion 20G of the attachment 20 is exposed from between the second guide 22L and the second guide 22R.

Finally, the user attaches the first guide 21 to either the second guide 22L and/or the second guide 22R. The user fixes the bracket 23 of the first guide 21 to the second guide 22L in the present preferred embodiment.

Accordingly, the mounting of the expansion device 19 onto the transom step 5A of the vessel body 2 is completed. The first guide 21 may be pre-attached to the second guide 22 (see FIG. 3), and, if so, the second guide 22 to which the first guide 21 has been fixed is attached to the attachment 20. Additionally, using a procedure opposite to the mounting procedure described above, the user is able to detach the expansion device 19 from the transom step 5A, and disassemble the expansion device 19 into the attachment 20, the first guide 21, and the second guide 22. Therefore, the attachment 20 is attachable and detachable to and from the transom step 5A, and the second guide 22L and the second guide 22R are attachable and detachable to and from the left edge 20B and the right edge 20C of the attachment 20 respectively, and the first guide 21 is attachable and detachable to and from the second guide 22.

Figure 5:
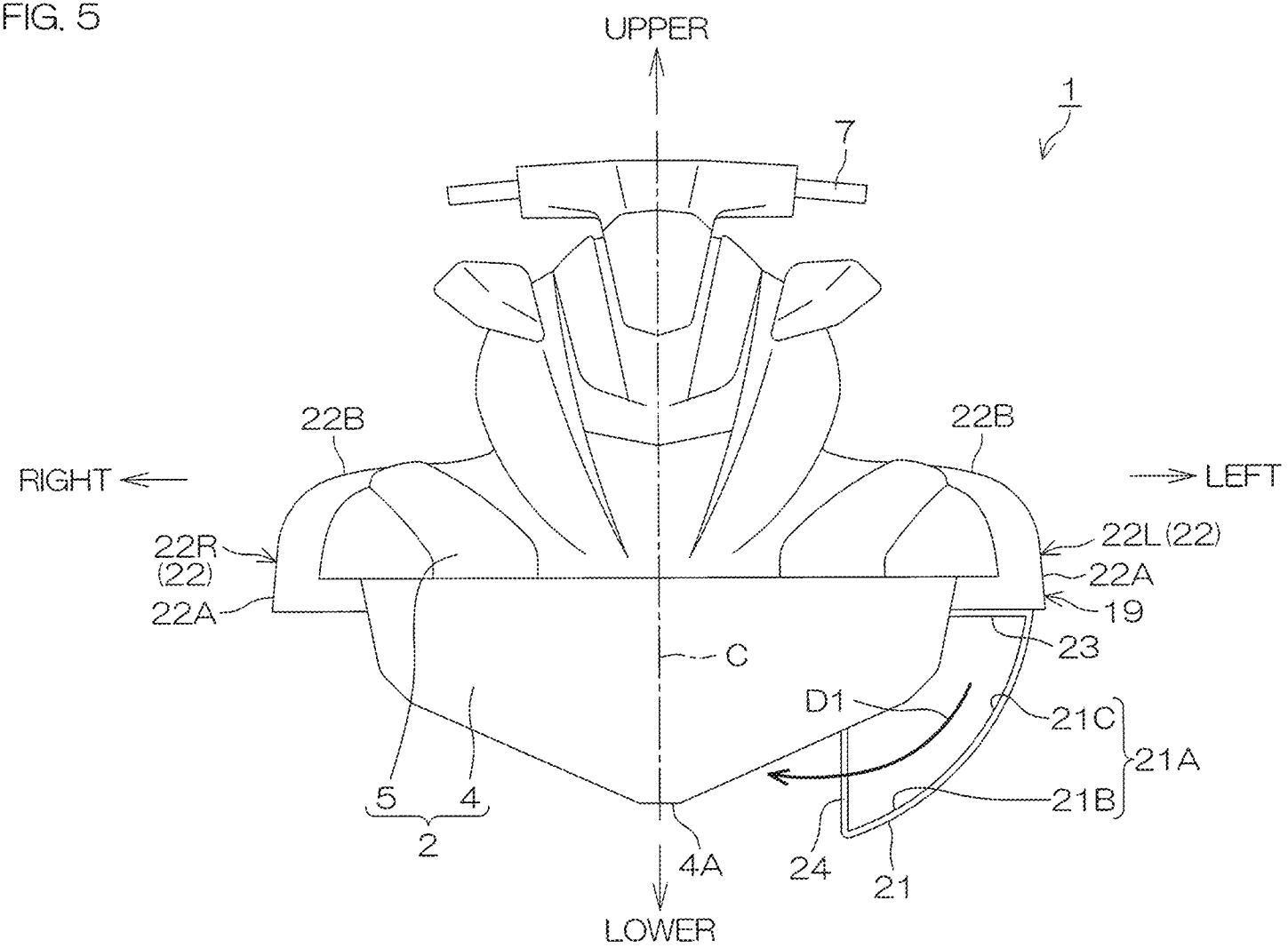
FIG. 5 is a front view of the jet propulsion watercraft on which the expansion device has been mounted.
Figure 6:
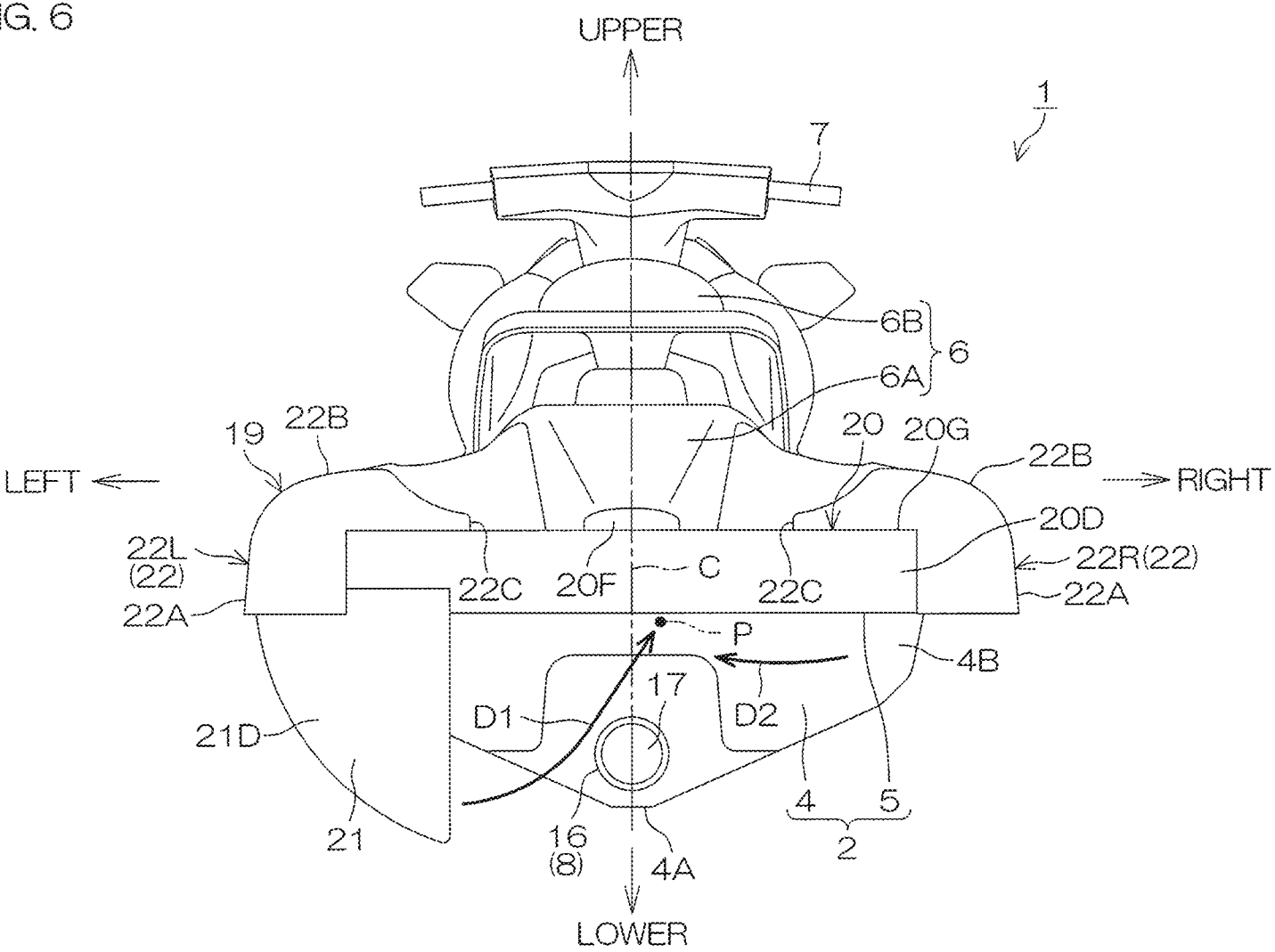
FIG. 6 is a rear view of the jet propulsion watercraft on which the expansion device has been mounted.

When the expansion device 19 is mounted on the transom step 5A, the first guide 21 that is attached only to the second guide 22L is disposed asymmetrically from the center C in the width direction of the vessel body 2 (see FIG. 5 and FIG. 6). The first guide 21 is disposed at a more lateral position than the jet opening 17 of the jet pump 8 (in the present preferred embodiment, the left side), and protrudes downwardly from a rear end portion of the inner guide 22B of the second guide 22L (see FIG. 6). An upper end portion of the first guide 21 is covered by the rear end portion of the outer guide 22A of the second guide 22L from the outside left.

The first guide 21 is curved so as to trace (overlap) a corner portion X at the left rear of the attachment 20 (i.e., a portion at which the left edge 20B and the rear edge 20D are joined together, see FIG. 3). The inner surface 21A and the outer surface 21D of the first guide 21 are curved along the rear end portion of the outer guide 22A. The inner surface 21A is curved so as to deviate more inwardly (in the present preferred embodiment, more rightwardly) as it extends downwardly in a front view (see FIG. 5).

When the expansion device 19 is attached to the transom step 5A, the front end of each second guide 22 is smoothly continuous with front portions of side edges (left and right edges) of the deck 5 so as not to significantly bulge outward from the front portions. The inner guide 22B of the second guide 22L and the inner guide 22B of the second guide 22R clamp the base portion 6A of the seat 6 between them in the width direction. Each inner guide 22B is disposed so as to slightly bulge outward from an upper surface of the attachment 20. A rear edge of each inner guide 22B substantially coincides with the rear edge 20D of the attachment 20.

A rider R (see FIG. 7) operates a throttle lever (not shown) of the steering handle 7 while sitting on the seat 6 of the jet propulsion watercraft 1 on which the expansion device 19 has been mounted, to cause the jet pump 8 to generate a forward thrust. Therefore, the jet propulsion watercraft 1 moves forwardly. Thus, water existing around the jet propulsion watercraft 1 flows relatively rearwardly.

A portion of water (hereinafter, referred to as "water D1") flowing on one lateral side (in the present preferred embodiment, the left side) of the vessel body 2 of the jet propulsion watercraft 1 moving forwardly passes through a space between the first guide 21 and the nozzle 15 and the deflector 16 of the jet pump 8. At this time, water D1 downwardly pushes the first region 21B of the inner surface 21A of the first guide 21, and is guided toward the other lateral side (in the present preferred embodiment, the right side) of the vessel body 2 by the second region 21C of the inner surface 21A. The first guide 21 generates a downforce by receiving water D1 in the first region 21B and by being pushed downwardly.

Thus, at least the rear portion of the vessel body 2 sinks lower in the water, and, as a result, a large wake W is generated behind the vessel body 2 as shown in FIG. 7. In the present preferred embodiment, a left rear portion of the vessel body 2 sinks more than a right rear portion of the vessel body 2, and, as a result, a wake W is generated behind a left region at which the first guide 21 is disposed on the vessel body 2. A wake co that is greatly smaller than the wake W is generated behind a right region at which the first guide 21 is not disposed on the vessel body 2.

The wake W is preferably a wake for wakesurfing. Therefore, a surfer S is able to ride a wake W with a surf board B, and enjoy wakesurfing more. In order to generate an even larger wake W, it is recommended to supply water to the ballast tank 18 so as to sink the front portion of the vessel body 2 lower in the water. Thus, the jet propulsion watercraft 1 moves forwardly in a state in which the entirety of the vessel body 2 sinks lower in the water, and, as a result, an even larger wake W is generated. The surfer S may stabilize his/her attitude while gripping a rope (not shown) that extends from the jet propulsion watercraft 1. If the surfer S is experienced, the surfer S is able to stabilize his/her attitude without gripping a rope.

The inner surface 21A of the first guide 21 guides water D1 to a position P that is more rearward and more upward than the jet opening 17 of the jet pump 8 (see FIG. 6). This position P is located near the center C in the width direction of the vessel body 2. Water D1 flowing on one lateral side of the vessel body 2 and water D2 flowing on the other lateral side of the vessel body 2 (see FIG. 4) are joined together at or around the position P. If the first guide 21 is not disposed on the vessel body 2, water D1 and water D2 are joined together at a position Q spaced rearwardly from the position P. Therefore, the first guide 21 sets a location at which water D1 and water D2 are joined together so as to be closer to the vessel body 2 compared to a case in which the first guide 21 is not disposed on the vessel body 2.

The outer guide 22A of each second guide 22 guides water D3 flowing on its lateral side toward the center C in the width direction of the vessel body 2. Additionally, the vessel body 2 is sunk lower in the water by a downforce generated by the first guide 21, and, as a result, water existing around the vessel body 2 is brought into contact with the vessel body 2. The inner edge 22C of the inner guide 22B of each second guide 22 guides water D4 that has been brought into contact with the vessel body 2 toward the center C. Therefore, a water surface region in the wake W generated by the first guide 21 is spaced apart from water D3 and water D4, and, as a result, the flow of water is straightened.

As described above, according to the present preferred embodiment, the jet pump 8 jets water from the jet opening 17, and, as a result, a thrust is generated, and the jet propulsion watercraft 1 travels. At that time, the first guide 21 attached to the vessel body 2 of the jet propulsion watercraft 1 receives water flowing on a lateral side of the vessel body 2, and a downforce is generated. Thus, the vessel body 2 sinks lower in the water, and therefore the displacement increases. Therefore, a larger wake W is generated behind the vessel body 2. This wake W may be a wake for wakesurfing. Therefore, it is possible to generate a wake W that is large enough to enable a surfer to enjoy wakesurfing even with the jet propulsion watercraft 1 that has a small displacement when in a stationary state. Therefore, it becomes possible to easily enjoy wakesurfing. Additionally, a user who already owns the jet propulsion watercraft 1 is able to enjoy wakesurfing at a small expense by later obtaining only the expansion device 19 and by attaching this expansion device 19 to the vessel body 2.

In the present preferred embodiment, when the user wants to wakesurf, a wake W for wakesurfing is generated by mounting the first guide 21 on the vessel body 2 and causing the jet propulsion watercraft 1 to travel, and therefore the user is able to enjoy wakesurfing by riding on this wake W.

In the present preferred embodiment, when the first guide 21 attached to the transom step 5A of the vessel body 2 generates a downforce, at least the rear portion of the vessel body 2 sinks lower in the water, and therefore the displacement increases at least in the rear portion of the vessel body 2 in the jet propulsion watercraft 1. Thus, a larger wake W for wakesurfing is generated behind the vessel body 2, and therefore the surfer S is able to enjoy wakesurfing by riding on the wake W that has become larger due to the vessel body 2 sinking lower in the water.

In the present preferred embodiment, the first guide 21 is disposed asymmetrically from the center C in the width direction of the vessel body 2. According to this arrangement, a wake W for wakesurfing is generated on a side closer to one lateral side in the width direction of the vessel body 2 (in the present preferred embodiment, the left side), and therefore the surfer S is able to enjoy wakesurfing by riding on this wake W when positioned on one lateral side at the rear.

In the present preferred embodiment, the first guide 21 is disposed at a more sideward position than the jet opening 17, and thus is disposed asymmetrically from the center C in the width direction of the vessel body 2. Thus, a wake W for wakesurfing is generated on a side closer to one lateral side in the width direction of the vessel body 2, and therefore the surfer S is able to enjoy wakesurfing by riding on this wake W when positioned on one lateral side at the rear.

In the present preferred embodiment, the first region 21B of the first guide 21 generates a downforce by being downwardly pushed by water D1 flowing on one lateral side of the vessel body 2, and therefore a wake W for wakesurfing is generated as described above. The second region 21C of the first guide 21 guides water D1 flowing on the one lateral side of the vessel body 2 toward the other lateral side of the vessel body 2 (in the present preferred embodiment, rightwardly). Water guided in this way crosses the jet opening 17 of the jet pump 8. Thus, a jet flow generated by water jetted from the jet opening 17 is reduced or prevented from reaching the water surface, and therefore it is unlikely for the jet flow to cause a spray of water. Therefore, it is possible to prevent a water surface portion of the wake W from becoming rough due to spraying of water onto the wake W, and therefore the surfer S is able to easily ride on the wake W generated by the first region 21B, and enjoy wakesurfing more.

In the present preferred embodiment, the first guide 21 guides water D1 flowing on one lateral side of the vessel body 2 to a position P that is located at a more rearward and more upward position than the jet opening 17. According to this arrangement, the first guide 21 generates a downforce by being downwardly pushed by water D1 flowing on one lateral side of the vessel body 2, and therefore a wake W for wakesurfing is generated as described above. The first guide 21 guides water D1 flowing on one lateral side of the vessel body 2 to a position P that is located at a more rearward and more upward position than the jet opening 17 of the jet pump 8. Water guided in this way crosses the jet opening 17 at this position P. Thus, it becomes less likely for a jet flow caused by water jetted rearwardly from the jet opening 17 to reach the water surface, and therefore it is unlikely for the jet flow to cause a spray of water. Therefore, it is possible to significantly reduce or prevent a water surface portion of the wake W from becoming rough due to the splashing or spraying of water onto the wake W, and therefore the surfer S is able to easily ride on the wake W generated by the first guide 21, and enjoy wakesurfing more.

In the present preferred embodiment, the first guide 21 sets a location at which water D1 flowing on one lateral side of the vessel body 2 and water D2 flowing on the other lateral side of the vessel body 2 are joined together so as to be closer to the vessel body 2 compared to a case in which the first guide 21 is not disposed on the vessel body 2. According to this arrangement, the first guide 21 guides water D1 flowing on one lateral side of the vessel body 2 to a position P located near the jet opening 17 of the jet pump 8. Water guided in this way crosses the jet opening 17 at the position P located near the jet opening 17 of the jet pump 8. Thus, it is less likely for a jet flow caused by water jetted from the jet opening 17 to reach the water surface, and therefore it is unlikely for the jet flow to cause a spray of water. Therefore, it is possible to significantly reduce or prevent a water surface portion of the wake W from becoming rough due to splashing or spraying of water onto the wake W, and therefore the surfer S is able to easily ride on the wake W generated by the first guide 21, and enjoy wakesurfing more.

In the present preferred embodiment, in the first guide 21 having a curved plate shape, the first region 21B and the second region 21C each of which is a curved surface are continuous with each other, and therefore it is possible for water D1 flowing on one lateral side of the vessel body 2 to smoothly pass through the entire area of the first and second regions 21B and 21C. Therefore, it is possible for the first guide 21 to generate a downforce by being pushed downwardly by water passing through the first region 21B and to guide water flowing through the second region 21C toward the other lateral side of the vessel body 2.

In the present preferred embodiment, not only the first guide 21 but also the ballast tank 18 disposed at the front portion of the vessel body 2 generates a downforce, and, as a result, the entirety of the vessel body 2 sinks lower in the water, and therefore the displacement of the jet propulsion watercraft 1 further increases. Thus, a larger wake W for wakesurfing is generated behind the vessel body 2, and therefore the surfer S is able to ride on a wake W that has become larger due to the vessel body 2 sinking lower in the water, and enjoy wakesurfing more.

In the present preferred embodiment, the attachment 20 attached to the transom step 5A of the vessel body 2 extends the transom step 5A of the vessel body 2 rearwardly, and therefore it is possible to expand the uses of the jet propulsion watercraft 1 by placing things on the attachment 20 or by attaching another device (in the present preferred embodiment, the first guide 21 or the second guide 22) to the attachment 20.

In the present preferred embodiment, the second guide 22 is disposed at a side edge of the attachment 20 to straighten a water surface region in a wake W generated by the first guide 21, and therefore it is possible to prevent a water surface portion of the wake W from becoming rough. Thus, the surfer S is able to easily ride on the wake W, and enjoy wakesurfing more.

In the present preferred embodiment, a combination of the attachment 20, the first guide 21, and the second guide 22 makes it possible to generate a wake W whose water surface portion is less rough, and therefore the surfer S is able to easily ride on the wake W, and enjoy wakesurfing more.

In the present preferred embodiment, it is possible for the user to attach or detach the second guide 22 when necessary.

In the present preferred embodiment, water D4 that has been brought into contact with the vessel body 2 is guided toward the center C in the width direction of the vessel body 2 by the inner guide 22B, and thus spaced apart from a wake W generated by the first guide 21. Therefore, it is possible to prevent a water surface portion of the wake W from becoming rough due to water D4 that has been brought into contact with the vessel body 2, and therefore the surfer S is able to easily ride on the wake W generated by the first guide 21, and enjoy wakesurfing more.

In the present preferred embodiment, the inner guide 22B that has the rear end portion 22D curved so as to approach the center C in the width direction of the vessel body 2 as it extends rearwardly effectively guides the water D4 that has been brought into contact with the vessel body 2 toward the center C.

In the present preferred embodiment, water D3 flowing on the lateral side of the outer guide 22A is guided toward the center C in the width direction of the vessel body 2 by the outer guide 22A, and thus is spaced apart from a wake W generated by the first guide 21. Therefore, it is possible to prevent a water surface portion of the wake W from becoming rough due to water D3 flowing on the lateral side of the outer guide 22A, and therefore the surfer S is able to easily ride on the wake W generated by the first guide 21, and enjoy wakesurfing more.

In the present preferred embodiment, it is possible for the outer guide 22A having the curved surface to smoothly guide water D3 flowing on the lateral side of the outer guide 22A toward the center C in the width direction of the vessel body 2.

Although preferred embodiments of the present invention have been described above, the present invention is not restricted to the contents of these preferred embodiments and various modifications are possible within the scope of the present invention.

For example, in the above-described preferred embodiments, the first guide 21 is attached to the second guide 22L, and a wake W is generated left behind the vessel body 2 on the assumption that one lateral side of the vessel body 2 is a left side and that the other lateral side of the vessel body 2 is a right side. Instead of this, the first guide 21 may be attached to the second guide 22R, and a wake W may be generated right behind the vessel body 2 on the assumption that one lateral side of the vessel body 2 is a right side and that the other lateral side of the vessel body 2 is a left side. The first guide 21 may be attachable to both the second guide 22L and the second guide 22R by reversing its attitude.

Additionally, in the above-described preferred embodiments, the first guide 21 is attached to either one of the second guides 22L and 22R. Instead of this, two first guides 21 that may differ from each other in size (magnitude or shape) may be attached to the second guide 22L and the second guide 22R, respectively. In this case, the first guide 21 is disposed asymmetrically from the center C in the width direction of the vessel body 2. The above-described wake W generated near the first guide 21 that is one of the right and left first guides 21 generates a larger downforce.

Additionally, the first guides 21 that are equal to each other in size may be attached to the second guide 22L and the second guide 22R, respectively. In this case, the two first guides 21 are disposed laterally symmetrically from the center C, and wakes W are generated on the left and right behind the vessel body 2, respectively. Therefore, two surfers are able to ride on the wakes W, respectively, and simultaneously enjoy wake surfing.

Additionally, when the expansion device 19 is attached to the vessel body 2, the upper surface of the attachment 20 and the upper surface of the second guide 22 may be inclined so as to descend as they extend rearwardly so as not to obstruct a water flow therearound.

Additionally, in the above-described preferred embodiments, all of the attachment 20, the first guide 21, and the second guide 22 are attached to the vessel body 2 to enjoy wakesurfing. To enjoy marine leisure differing from wakesurfing, only the attachment 20 may be attached to the vessel body 2. In that case, for example, fishing tackle, a cold box, etc., are able to be carried while being placed on the attachment 20, or a user may enjoy fishing in a state in which the user is standing up on the attachment 20. A non-skid treatment may be applied to the attachment 20 so that user is able to perform tasks on the attachment 20.

Various features described above may be appropriately combined together.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propulsion watercraft comprising:

a vessel body;

a jet pump disposed on the vessel body and including a water jet opening to generate a thrust by sucking in water around the vessel body and jetting the water from the water jet opening; and a first guide attached to the vessel body to receive water flowing on a lateral side of the vessel body and to generate a downforce that generates a wake behind the vessel body; wherein the first guide includes a first region that is downwardly pushed by water flowing on the lateral side of the vessel body and a second region that guides water flowing on the lateral side of the vessel body toward another lateral side of the vessel body.

2. The jet propulsion watercraft according to claim 1, wherein the wake is a wake for wakesurfing.

3. The jet propulsion watercraft according to claim 2, wherein the first guide is detachably attached to the vessel body.

4. The jet propulsion watercraft according to claim 3, wherein the first guide is detachably attached to a rear portion of the vessel body.

5. The jet propulsion watercraft according to claim 3, wherein the first guide is disposed asymmetrically from a center of the vessel body in a width direction of the vessel body.

6. The jet propulsion watercraft according to claim 5, wherein the first guide is disposed at a more sideward position than the water jet opening.

7. The jet propulsion watercraft according to claim 1, wherein the first guide guides water flowing on the lateral side of the vessel body to a more rearward and more upward position than the water jet opening.

8. The jet propulsion watercraft according to claim 7, wherein the first guide sets a location at which water flowing on the lateral side of the vessel body and water flowing on the other lateral side of the vessel body are joined together so as to be closer to the vessel body compared to a case in which the first guide is not disposed on the vessel body.

9. The jet propulsion watercraft according to claim 6, wherein the first guide includes a curved plate; and the first region and the second region include curved surfaces that are continuous with each other.

10. The jet propulsion watercraft according to claim 2, further comprising a ballast tank disposed at a front portion of the vessel body.

11. The jet propulsion watercraft according to claim 2, further comprising an attachment plate that is detachably attached to a rear portion of the vessel body and that extends the rear portion of the vessel body rearwardly.

12. The jet propulsion watercraft according to claim 11, further comprising a second guide disposed at a side edge of the attachment plate and that straightens a water surface region in a wake generated by the first guide.

13. A jet propulsion watercraft comprising:

a vessel body;

a jet pump disposed on the vessel body and including a water jet opening to generate a thrust by sucking in water around the vessel body and jetting the water from the water jet opening;

a first guide attached to the vessel body to receive water flowing on a lateral side of the vessel body and to generate a downforce that generates a wake behind the vessel body;

an attachment plate that is detachably attached to a rear portion of the vessel body and that extends the rear portion of the vessel body rearwardly; and a second guide disposed at a side edge of the attachment plate and that straightens a water surface region in a wake generated by the first guide; wherein the first guide is attached to the second guide.

14. The jet propulsion watercraft according to claim 12, wherein the second guide is attachable and detachable to and from the side edge of the attachment plate.

15. A jet propulsion watercraft comprising:

a vessel body;

a jet pump disposed on the vessel body and including a water jet opening to generate a thrust by sucking in water around the vessel body and jetting the water from the water jet opening;

a first guide attached to the vessel body to receive water flowing on a lateral side of the vessel body and to generate a downforce that generates a wake behind the vessel body;

an attachment plate that is detachably attached to a rear portion of the vessel body and that extends the rear portion of the vessel body rearwardly; and a second guide disposed at a side edge of the attachment plate and that straightens a water surface region in a wake generated by the first guide; wherein the second guide includes an inner guide that guides water that has been brought into contact with the vessel body toward the center in the width direction of the vessel body.

16. The jet propulsion watercraft according to claim 15, wherein a rear end portion of the inner guide is curved so as to approach the center as the rear end portion extends rearwardly.

17. The jet propulsion watercraft according to claim 15, wherein the second guide includes an outer guide that is disposed farther apart from the center in the width direction than the inner guide; and the outer guide guides water flowing on a lateral side of the outer guide toward the center.

18. The jet propulsion watercraft according to claim 17, wherein the outer guide includes a curved surface.

* * * * *